US009515430B2

(12) United States Patent
Saller et al.

(10) Patent No.: US 9,515,430 B2
(45) Date of Patent: Dec. 6, 2016

(54) ANGULAR HIGH-VOLTAGE PLUG

(71) Applicant: Lisa Dräxlmaier GmbH, Vilsbiburg (DE)

(72) Inventors: Robert Saller, Egglkofen (DE); Christian Wimmer, Schalkham (DE); Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/374,802

(22) PCT Filed: Jan. 8, 2013

(86) PCT No.: PCT/EP2013/050186
§ 371 (c)(1),
(2) Date: Jul. 25, 2014

(87) PCT Pub. No.: WO2013/110490
PCT Pub. Date: Aug. 1, 2013

(65) Prior Publication Data

US 2014/0377990 A1 Dec. 25, 2014

(30) Foreign Application Priority Data

Jan. 26, 2012 (DE) ..... 10 2012 201 123

(51) Int. Cl.
*H01R 24/38* (2011.01)
*H01R 4/10* (2006.01)

(52) U.S. Cl.
CPC ..... *H01R 24/38* (2013.01); *H01R 4/10* (2013.01); *H01R 2201/26* (2013.01)

(58) Field of Classification Search
USPC ..... 439/582, 578, 581, 585
See application file for complete search history.

(56) References Cited

U.S. PATENT DOCUMENTS 4,241,973 A * 12/1980 Mayer ..... H01R 24/40 174/73.1
4,772,222 A * 9/1988 Laudig ..... H01R 9/05 439/578

(Continued)

FOREIGN PATENT DOCUMENTS

CN 101015097 A 8/2007
CN 102157817 A 8/2011

(Continued)

OTHER PUBLICATIONS

Notification of the First Office Action of Chinese Application No. 201380006978.2 dated Dec. 2, 2015 (17 pages including translation).

(Continued)

*Primary Examiner* — Alexander Gilman
(74) *Attorney, Agent, or Firm* — Finnegan, Henderson, Farabow, Garrett & Dunner LLP

(57) ABSTRACT

An angular high-voltage plug that connects to a cable is described for use in high-voltage electrical systems of motor vehicles. The angular high-voltage plug includes an electrically insulating monolithic housing. The plug also includes an outer conductor and an inner conductor. The outer conductor includes a first outer conductor part at the cable that includes a connecting area and a linking area and a second outer conductor part at the plug. The first outer conductor part and the second outer conductor part are interconnected using an interference fit.

9 Claims, 7 Drawing Sheets

(56) References Cited

U.S. PATENT DOCUMENTS

| | | | | |
|---|---|---|---|---|
| 6,283,790 | B1 * | 9/2001 | Idehara | H01R 13/504 439/582 |
| 7,121,883 | B1 * | 10/2006 | Petersen | H01R 9/0521 439/582 |
| 7,419,403 | B1 * | 9/2008 | Paynter | H01R 9/0521 439/578 |
| 7,946,886 | B1 * | 5/2011 | Liu | H01R 9/05 439/582 |
| 2004/0014358 | A1 * | 1/2004 | Leve | H01R 24/545 439/581 |
| 2004/0137790 | A1 * | 7/2004 | Lee | H01R 4/28 439/582 |
| 2007/0212936 | A1 * | 9/2007 | Eckel | H01R 24/38 439/578 |
| 2008/0293298 | A1 * | 11/2008 | Burris | H01R 13/025 439/582 |
| 2011/0008999 | A1 * | 1/2011 | Annequin | H01R 24/54 439/582 |
| 2011/0021075 | A1 * | 1/2011 | Orner | H01R 9/0518 439/585 |
| 2012/0021645 | A1 * | 1/2012 | Marsh | H01R 11/12 439/578 |
| 2013/0012062 | A1 * | 1/2013 | Nugent | H01R 9/05 439/578 |
| 2013/0157504 | A1 * | 6/2013 | Sykes | H01R 24/44 439/578 |
| 2013/0157505 | A1 * | 6/2013 | Sykes | H01R 9/05 439/578 |
| 2014/0377990 | A1 * | 12/2014 | Saller | H01R 4/10 439/582 |

FOREIGN PATENT DOCUMENTS

| | | | |
|---|---|---|---|
| DE | 10 2009 043516 | A1 | 4/2011 |
| EP | 1 883 135 | A1 | 1/2008 |
| GB | 2469023 | A | 10/2010 |
| WO | WO 2008/089588 | A1 | 7/2008 |

OTHER PUBLICATIONS

International Search Report of PCT/EP2013/050186, dated May 6, 2013 (2 pages).

* cited by examiner

ANGULAR HIGH-VOLTAGE PLUG

CROSS-REFERENCE TO RELATED APPLICATIONS

This is a U.S. National Phase of PCT/EP2013/050186, filed Jan. 8, 2013, which claims the benefit of priority to German Patent Application No. 10 2012 201 123.4 filed Jan. 26, 2012, the contents of both which are incorporated herein by reference.

FIELD OF TECHNOLOGY

The invention relates to an angular high-voltage plug for use in motor vehicles.

BACKGROUND

Because of decreasing petrochemical raw material resources, which have been primarily used as fuel in the combustion engines of motor vehicles, the development of mobility concepts where vehicles are operated with battery- or accumulator-driven electric motors, either alone or in combination with an additional non-electrical energy source, (e.g. as a so-called hybrid-drive) is increasing.

As a consequence, in the future, traditional 14-volt motor vehicle electrical systems may be supplemented or completely replaced with vehicle electrical systems with significantly higher voltages of 200-750 volts. If this occurs, the connecting systems that have been used until now may not be suitable to handle the phenomena related to such high voltages.

At the same time, it may not be possible to simply use the connection concepts of stationary technologies, where similarly high voltages are used, because they are not designed for the conditions prevalent in motor vehicles.

In particular, the connections may need to be developed in such a manner that the vibrations created in the operation of the motor vehicle do not negatively impact the quality of the connection in the medium- or long-term. This specifically concerns the quality of the cable contacts, which are often shielded cables having much larger inner cable diameters (e.g., exceeding 50 $mm^2$) of copper, but also increasingly of aluminum (including alloys of each).

Furthermore, high demands are made on connections for electric and hybrid motor vehicles with respect to tightness. The infiltration of debris such as, for example, oil, anti-freeze agents, road salt, liquid water or dust, which could have a negative impact on the quality of the connection in the medium term, should be avoided.

The connections should be designed in such a way that temperatures of up to 200° C. which may be found in motor vehicles, do not impact the functionality of the motor vehicle electrical system.

Because of the close proximity to electronic devices such as, for example, the electrical entertainment systems of motor vehicles, a complete screening of the motor vehicle electrical system may need to be guaranteed in the connecting area as well.

Furthermore, current-carrying cables may cause injury during operation or during the assembly and/or maintenance of the motor vehicles, or in case of accidents.

Finally, improvements to the efficiency of the production and assembly of the connecting concepts may be made with respect to resources. For example, the effort in terms of capital, time and material may be reduced.

SUMMARY

One object of the disclosed embodiments is to provide an angular high-voltage plug that may be used in the electrical system of motor vehicles, as well as a method for the production of said plug.

This object may be attained with an angular high-voltage plug having the characteristics consistent with embodiments of the disclosure.

According to the disclosure, a high-voltage plug for use in motor vehicle electrical systems has a monolithic, electrically insulating housing made of a suitable plastic material.

The housing consists of a material that may be suitable for use at temperatures of up to 200° C. which may occur when the electrical plug connector is used in motor vehicles, and can also take up and transmit forces without significant deformation or fragility. A suitable material may be a plastic material or a composite plastic material with a significant proportion of polyamide. For example a partially aromatic copolyamide that may be fiber-reinforced and has a fiber (e.g., glass fibers or mineral fibers) portion of more than 20 percent by weight (pbw), such as 25 pbw, may be used. Such plastic materials may be additionally characterized by a very low permeability, which may prevent the diffusion of interfering media, such as water molecules, for example, into the housing.

The housing may be economically produced in a conventional injection molding process.

The housing may have at least one cavity wherein additional plug components may be arranged. If the housing is to be used to create a multi-connection, such as a double or triple plug connector, a plurality of cavities arranged side-by-side and electrically insulated from each other can be provided in the housing. Alternately, a single cavity of sufficient size can be arranged in the housing, and the individual plugs of a multi-plug connector are electrically separated by insulation arranged between them.

To arrange additional plug components, the cavity may be accessible via two openings, with the openings being designed so that the components for connecting to a cable of the motor vehicle electrical system and the components for connecting to a corresponding element such as a plug receptacle are arranged at an angle, such as 90°, relative to one another.

At least one outer conductor and one inner conductor are arranged in the cavity of the housing. The outer conductor may include a first outer conductor part at the cable and a second outer conductor part at the plug. The cavity may be designed so that a first outer conductor part can be introduced with positive fit through a first opening. Furthermore, sections of the cavity may be designed corresponding to the form of the first outer conductor part so that the first outer conductor part may be inserted in only one angular position relative to the direction of insertion and its position is affixed in the housing relative to the angular position after it has been inserted. In this example, the housing may have ridges in the cavity which run parallel to the direction of insertion and engage in corresponding grooves at the outer side of the first outer conductor part.

In the direction of insertion, the first outer conductor part is mounted in a floating fashion. This has the advantage that tolerances in the connection of the plug and a corresponding plug receptacle can be compensated.

A second outer conductor part can be inserted through the second opening in the cavity, with the cavity being designed in this area contrary to the area discussed earlier with respect to the first outer conductor part, so that the second outer conductor part can be arranged in the cavity with positive fit, but also in a rotating fashion. The second opening may be cylindrical, with the longitudinal axis of the second opening being arranged relative to the longitudinal axis of the first opening in the desired angular position of the plug.

The second outer conductor part at the plug may be used as a screen sleeve for the mechanical and electrical connection to a screen contact of a correspondingly designed plug receptacle, whereas the first outer conductor part at the cable may be provided for electrical and mechanical contact with the screening of a cable of the motor vehicle electrical system.

The two parts of the outer conductor are components with an outer contour that may allow a linear insertion by sliding and/or pressing the first and second outer conductor part into the respective openings in the housing provided for this purpose and may be developed according to the contour of the outer conductor parts. Additionally, the first outer conductor part has a lateral opening that may accommodate the second outer conductor part and may geometrically correspond to the outer contour of the second outer conductor part provided for the connection.

The outer conductor may sheath the inner conductor with the exception of the areas provided for contacting at the cable and the plug.

The opening in the first outer conductor part may be designed so that a second inner conductor part for contacting the first inner conductor part, as well as a second outer conductor part provided concentrically about the second inner conductor part, which is already described above, can be arranged in the opening.

According to an embodiment, the first and the second outer conductor part may be interconnected using a press fit. Such a non-positive, preferably continuous, connection between the two parts of an outer conductor of a plug cars be created very easily and at the same time ensures, due to the overlapping of the two parts in the area of the interference fit, that the inner conductor part may be completely screened. For example, the receptacle of the first and second outer conductor part in the housing can ensure that the two parts of the outer conductor are properly positioned in the housing relative to one another with respect to the press contacting. This exemplary arrangement of the outer conductor in the housing and the very robust crimped connection may also ensure sufficient screening of the inner conductor in the area of the plug when it is used in a plug connector in the electrical system of a motor vehicle.

In an embodiment, the inner conductor may include a first inner conductor part at the cable and a second inner conductor part at the plug.

The first inner conductor part may be used for contacting a load conductor of a cable of the motor vehicle electrical system. The second inner conductor part may contact a load conductor of a correspondingly designed plug receptacle.

The first and the second inner conductor part may be developed as components with an outer contour that may allow a linear insertion by sliding and/or pressing the first and second inner conductor part into the respective additional components of the plug, which may be in the housing at the time the inner conductor is assembled and may have openings that correspond to the contour of the inner conductor parts. The first inner conductor part may have an additional opening for the lateral accommodation of the second inner conductor part and accordingly corresponds geometrically to the outer contour of the second inner conductor part.

The first inner conductor part may be surrounded by an insulator. The insulator may be arranged in the first outer conductor part with a positive fit. When in a fixed position the fit may be non-positive. The insulator may have a lateral opening chat may be penetrated by the second inner conductor part.

In an embodiment, the first inner conductor part and the second inner conductor part stay be interconnected using an interference fit. An interference fit may ensure that the electrical contact of the two parts of the inner conductor function reliably even under mechanical stress, such as the stress that systems of a motor vehicle may put on the plug. The interference fit may eliminate interruptions. Furthermore, the interference fit may eliminate electric arcs that could damage the contact parts, the housing, or other components of the motor vehicle electrical system such as electronics. In an embodiment, the interference fit may create an electrical contact between the first and the second inner conductor part, which may be a low contact resistance and therefore may lead to having a slight temperature increase in the area of the interference fit when high voltages are applied later on during operation.

This embodiment may be advantageous when the first outer conductor part is a component produced in a machining process (e.g., if it is cut from a block of material and/or turned on a lathe or otherwise machined). In this way, the aforementioned geometries for arranging and/or optimally connecting the first outer conductor part to the adjacent other components of the plug, such as the second outer conductor part, the insulator, or the housing, may be produced in a simple process.

In certain embodiments, the first outer conductor part may consist of copper or a copper alloy. For example, the first outer conductor may be made of a short-chipping copper alloy. A short-chipping copper alloy may allow for more efficient production of a high-quality first outer conductor part in a machining process. In an embodiment, the surface of the first outer conductor part and the other current-carrying components of the plug may he coated completely or partially with an additional material, such as tin, silver or gold, for example, which may result in an improved contact resistance (e.g., an increased conductivity at the connecting point of two components and/or a reduced oxidation tendency of the components).

In an embodiment, the first outer conductor part may be separated into a linking area and a connecting area. The areas may be two different components. For example, only the connecting area of the first outer conductor part may be produced in a machining process. The connecting area may have the opening in which the second outer conductor part is arranged. The linking area may be a tubular section, for example, which is developed in a geometrically simple fashion and may be available over the counter. The linking area may be connected to the connecting area before the plug is assembled, for example by pressing.

The first inner conductor part may have a connecting area with an opening in which the second inner conductor part is arranged. Adjacently, the first inner conductor part may have a linking area for contacting the load conductor of a cable.

In an embodiment, the centers of the openings in the connecting areas of the first inner conductor part and the first outer conductor parts may be on a joint axis. A joint axis may allow the second inner conductor and the second outer conductor to be interconnected in a single press tool, for example in a single press stroke.

In an embodiment, the quality of the interference fit may be ensured when the first outer conductor part and the first inner conductor part have parallel, preferably plane-parallel bearing surfaces in the connecting area. In this embodiment, the forces that may occur when the second outer conductor part is pressed into the first outer conductor part and/or when the second inner conductor part is pressed into the first inner conductor part may not damage or destroy the housing or the insulator arranged about the first inner conductor part. For example, there may be a homogenous introduction of force into a press receptacle where the housing is arranged during the production of the plug.

The insulator may consist of a material that is suitable for the temperatures of up to 200° C., which may occur in a motor vehicle when using the plug connector. The plug connector may transmit the forces that occur in the pressing of the inner conductor part without significant deformation. For example, a plastic material or a plastic material composite with a significant proportion of polyamide, such as a partially aromatic copolyamide, which may be fiber-reinforced and may have a glass- or mineral fiber portion of more than 20 percent-by-weight, such as 25 percent-by-weight, may be used.

In an embodiment, the insulator may have bearing surfaces that are parallel, such as plane-parallel, relative to the bearing surface of the first inner conductor part.

In an embodiment, the construction of the first inner conductor part, said inner conductor part may include a form-stable, plate- or strip-shaped component part may have an opening at one side that may accommodate the second inner conductor part.

For example, the insulator may have a recess that may be parallel to the longitudinal axis of the insulator that may accommodate the first inner conductor part. Sections of the recess may be slot-shaped. To facilitate a simple assembly of the first inner conductor part in the insulator, the entry opening of the slot-shaped recess may be dimensioned larger than the areas of the first inner conductor part provided for the accommodation. For example, the entry opening may be higher and/or wider than the areas of the first inner conductor pare that first penetrate said opening. To take up the forces created in connecting the first and second inner conductor part, the recess may have bearing surfaces adjacent to the opening in the connecting segment of the first inner conductor part, which may be designed to fix said first inner conductor part in the insulator. For example, two bar-shaped bearing surfaces that project into the recess are provided adjacent to the opening at opposite sides of the recess. In an embodiment, it may be possible to provide bearing surfaces that surround the opening on three or four sides. In an embodiment, it may be possible to surround the opening completely or partially annularly with one or a plurality of bearing surfaces that are bent corresponding to the form of the opening. In addition to fixation, this exemplary arrangement of the part of the second inner conductor part in the opening may also slightly project through the first inner conductor part without damaging the insulator when generating the interference fit.

In an embodiment, the housing may have, adjacent to the connecting area of the first outer conductor part, an inner and an outer surface. For example, two parallel, such as plane-parallel, bearing surfaces may be arranged parallel to the bearing surface of the first outer conductor part.

In an embodiment, a clasp may be arranged at the housing, which may, in the connection of the high-voltage plug and the corresponding plug receptacle, reduce the forces required for the assembly and/or facilitates needed for the assembly. For example, in the production of the high-voltage plug, the clasp may be detachably arranged at the housing. This may allow for attachment of the clasp at the housing after the pressing of the inner- and outer conductor parts is performed. In an embodiment, the clasp may be pivot ally arranged at the housing such that it may not negatively impact the pressing process in a pivotable position.

An embodiment may include a clasp with a lock that may protect the connection of plug and corresponding plug receptacle from unintended or unauthorized opening.

A robust linking may be achieved when the contacting of the first inner conductor and the load conductor is performed with firm bonding. For example, the first inner conductor may be welded to the load conductor of the cable. This may allow identical first inner conductors to be used even when the load conductors are made of various materials (e.g., copper or aluminum and/or their alloys).

In an embodiment, the first outer conductor part may be pressed at the cable with the screen of the cable using a supporting sleeve that encloses the screen. The supporting sleeve may lead to a defined connection with the screen (screen braid, screen foil) of the cable and the pressing of the first outer conductor part and the supporting sleeve may ensure that the components arranged in the first outer conductor part, as well as the first inner conductor part and the insulator surrounding said first inner conductor part, may be enclosed to be secured against loss and in a fixed position.

The connecting area of the first outer conductor and the screen of the cable preferably can be provided with an additional seal which, for example, is arranged on the cable with a cap before the load conductor of the cable is connected to the inner conductor. The cap may have notches that can be connected to appropriately designed notch receptacles at the housing to position the seal in its actuation position by connecting the cap to the housing of the plug.

For example, a seal provided at the plug can interact with the correspondingly designed plug receptacle. If the plug is developed as a multi-plug, the plug may form a sum seal (e.g., the seal may be arranged adjacent to the housing wall in such a fashion that it may encircle all plug areas of the multi-plug and seal them in the plug receptacle after the plug has been assembled).

In an embodiment, an annular snap element may be connected to the housing to fixate the seal. For example, an annular snap element may be pressed into the housing.

In an embodiment, the snap element may be simultaneously developed to accommodate an interruption identification (e.g., an "interlock") of the plug connector. The interruption identification may monitor the correct positioning of the plug in the plug receptacle. By fastening the interruption identification at the snap element, a simple and economical solution for identification may be created. The interruption identification may be fastened at the housing of the plug in one of the last assembly steps so that any damage to said component can be largely avoided during the assembly of the plug.

In an embodiment, an electrical system for a motor vehicle, such as an electric or hybrid motor vehicle, may have an angular high-voltage plug in accordance with the preceding embodiments.

The production of an angular high-voltage plug according to the invention may include the following steps, some of which were previously discussed:

The housing described above may be produced in an injection molding process.

Independent of time and space, the load conductor of a cable of a motor vehicle electrical system can be connected to the first inner conductor part. For example, the load conductor may be welded to the first inner conductor part.

In an embodiment, before the first inner conductor part is connected to the load conductor, a cap and a seal can be arranged on the cable to later seal the housing in the area of the connection at the cable.

In a next step, an insulator may be arranged at least about the connecting area of the first inner conductor part. At the same time or in a next step, the first outer conductor can be arranged about the insulator.

In an embodiment, a supporting sleeve may be arranged on the screening of the cable prior to the assembly of the first outer conductor, for example, by pressing it with the screening.

In a next step, the first outer conductor may be connected to the cable screen, such using the screen sleeve. For example, the first outer conductor may be connected to the cable screen through pressing and crimping.

In an embodiment, the thirst outer conductor connected to the cable and the first inner conductor disposed therein, which may be surrounded by the insulator for electrical separation from the first outer conductor, may be arranged in the housing.

In an embodiment, the cap on the cable can be used to affix the first outer conductor relative to the housing.

In a next step, the second outer conductor and the second inner conductor may be arranged in the housing.

In an embodiment, thereafter, at least the second outer conductor may be connected to the first outer conductor using an interference fit. In an embodiment, the first inner conductor may be simultaneously connected to the second inner conductor using an interference fit as well.

In an embodiment, at the same time or immediately after the connection between the outer conductor parts and/or the inner conductor parts, an insulator cap may be pressed into the space between the second inner conductor part and the second outer conductor part.

In an embodiment, a circumferential seal may be arranged in the housing at the plug to complete the plug. The circumferential seal may be connected to the housing using, for example, an annular snap element, which can have an additional interruption identification, when applicable.

In an embodiment, the next step may include a clasp being affixed to the housing, for example, by snapping or clipping.

The angular high-voltage plug according to the invention can be produced in a few production steps that may be easily automated and qualitatively monitored in a simple fashion. It may be especially suitable for use in electrical systems of motor vehicles, such as electric or hybrid motor vehicles.

DESCRIPTION OF THE EMBODIMENTS

Figure 1:
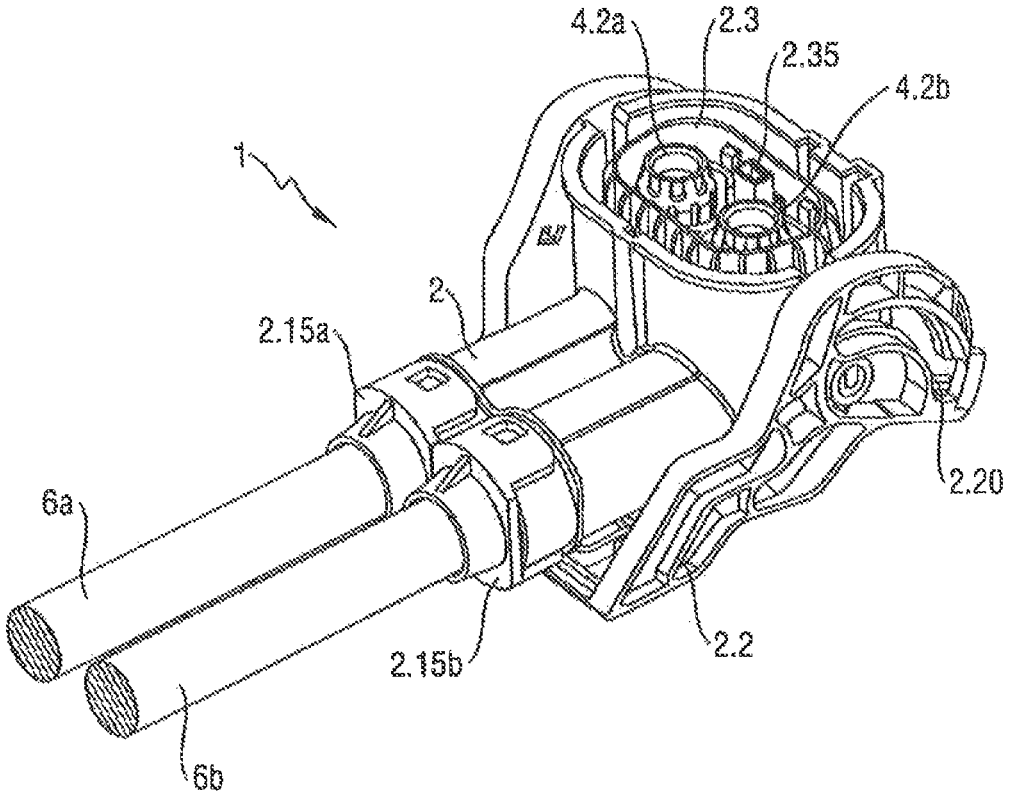
FIG. 1 shows an angular high-voltage plug according to an example embodiment in a perspective representation.

FIG. 1 shows an angular high-voltage plug 1 according to embodiments of the disclosure. The angular high-voltage plug 1 may be developed as a two-fold plug and accordingly connected to two cables 6*a*, 6*b* of an electrical system of a motor vehicle. At the cable, the housing 2 of the plug 1 may be closed by two caps 2.15*a*, 2.15*b*. The caps 2.15*a;* 2.15*b* can be snapped into the housing 2 and each simultaneously positions a seal (not shown) to prevent media from entering at the respective connecting point of the plug and one of the cables. A clasp 2.2 may be attached at the housing 2, in particularly to facilitate the assembly of the angular high-voltage plug 1 at a correspondingly developed plug receptacle (not shown). The shown clasp 2.2 additionally has part of a lock 2.20 to secure the plug connector consisting of plug and plug receptacle against unintended release. At the plug, the angular high-voltage plug 1 has two contacts of which only the two insulator caps 4.2*a*, 4.2*b* are visible in FIG. 1. The contacts are snapped into a corresponding plug receptacle. An annular snap element 2.3 may be visible annularly about the two insulator caps 4.2*a*, 4.2*b*. Said annular snap element 2.3 may affix a seal (not shown) at the plug. At the same time, an interruption identification 2.35 may be arranged at the annular snap element 2.3. Said interruption identification 2.35 may be a so-called interlock bridge that may be arranged in a recess provided at the annular snap element 2.3.

Figure 2:
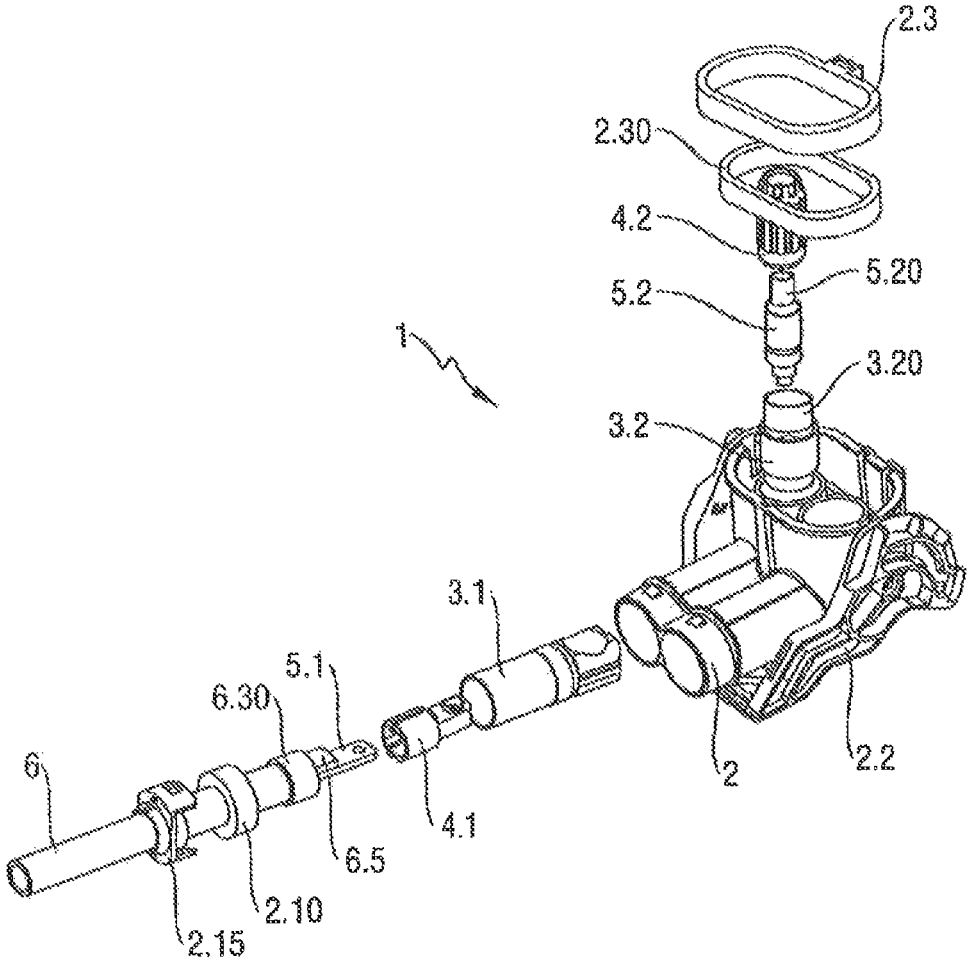
FIG. 2 also shows an angular high-voltage plug according to an example embodiment in an exploded representation.

FIG. 2 shows an angular high-voltage plug 1 in accordance with embodiments of the disclosure in an exploded view. An example of a cable 6 of an electrical system of a motor vehicle is shown, at which already a plurality of components of the annular high-voltage plug 1 may be arranged. A cap 2.15 and a seal 2.10 to close and seal the end of the housing 2 at the cable may be slid onto the cable. The cable 6 may be a screened cable with a screening braid that was placed around the cable in the linking area of the cable 6 over the outer insulation and may be affixed on the same with a supporting sleeve 6.30. The load conductor 6.5 of the cable, which cure project from the cable 6 in the connecting area, may be welded to the first inner conductor part 5.1 of the angular high-voltage plug 1. Adjacently to the first inner conductor part 5.1, an insulator 4.1 is shown, in which the first inner conductor part 5.1 may be arranged. The insulator 4.1 may have a lateral opening through which the first inner conductor part 5.1 may be contacted. To contact the supporting sleeve 6.30, which may electrically interact with the screening braid of the cable, the first outer conductor part 3.1 may have a tubular receptacle section. Furthermore, the first cuter conductor part 3.1 may nave a lateral opening through which she first inner conductor part 5.1, which may be arranged in the first outer conductor part 3.1 after the plug is assembled, can be contacted. The first outer conductor part 5.1 may have an outer contour that may allow sliding said first outer conductor part linearly into a correspondingly developed part of a cavity in the housing 2. At the plug, a second outer conductor part 3.2 and a second inner conductor part 5.2, which may be arranged in said second outer conductor part 3.2, may be introduced into the cavity in the housing 2. An insulator cap 4.2 may be arranged between the second inner conductor part 5.2 and the second outer conductor part 3.2 for the electrical insulation of both parts. The second outer conductor part 3.2 as well as the second inner conductor part 5.2 may have on their inner circumference a puncture in which one each contact element 3.20, 5.20 may be arranged. The contact element may be an annular contact lamella. According to an embodiment, the first and the second outer conductor part 3.1, 3.2 may be joined by pressing after being arranged in the housing 2 in such a fashion that an interference fit may be created between the two parts. At the same time, the first and the second inner conductor part 5.1, 5.2 may also be interconnected using an interference fit in the shown embodiment. To seal the plug connector at the plug, the angular high-voltage plug connector 1 may nave a circumferential seal 2.30, which may be affixed at the housing 2 by an annular snap element 2.3.

Figure 3:
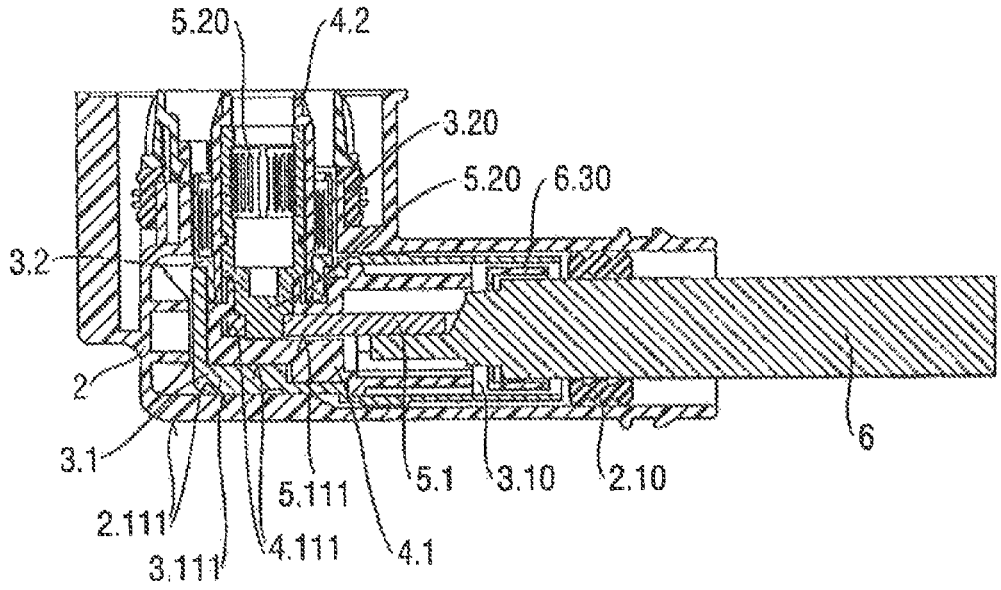
FIG. 3 shows an angular high-voltage plug according to an example embodiment in a sectional view.

An example sectional view of an angular high-voltage plug connector 1 is shown in FIG. 3. In the housing 2, the first outer conductor part 3.1 and the second outer conductor part 3.2, which may be connected using an interference fit, may be arranged in a cavity with positive fit. At its underside, the housing may have two parallel bearing surfaces 2.111. With the outer bearing surface 2.111 of the housing 2, said housing can be arranged in a press to connect the outer conductor parts 3.1. 3.2. Parallel to the bearing surfaces 2.111, the housing 2 may have a parallel bearing surface 3.111 relative to said bearing surfaces. Inside the first outer conductor part 3.1, the insulator 4.1 may be arranged with the first inner conductor part 5.1, which may be in the insulator. The first inner conductor part 5.1 may be developed as a lamellar component with at least two parallel sides. One of the sides may form a bearing surface 5.111 with which the first inner conductor 5.1 rests on the parallel bearing surface 4.111 developed at the insulator 4.1, At its one end, the first inner conductor 5.1 may be welded to the load conductor of the cable 6 and may be penetrated at the opposite end by the second inner conductor part 5.2 and connected to the same using an interference fit. The pressure exerted by the pressing tool when generating the interference fit between the first and second outer conductor part 3.1, 3.2 and/or first and second inner conductor part 5.1, 5.2 can be taken up by the previously mentioned bearing surfaces 2.111; 3.111; 4.111; 5.111 of the individual plug components, which may be arranged parallel to one another, which may create a high-quality connection without damaging adjacent components. The second inner conductor 5.2 may have at its inner circumference a notch in which a lamella-like contact element 5.20 may be arranged. Likewise, the second outer conductor may have at its inner circumference a cutting in which a lamella-like contact element 3.20 may be arranged as well. In an embodiment, the lamella-like contact elements 3.20; 5.20 may have an identical structure with the exception of the diameter. For example, they may be removed from an identically band-like semi-finished product and then bent differently.

Figure 4:
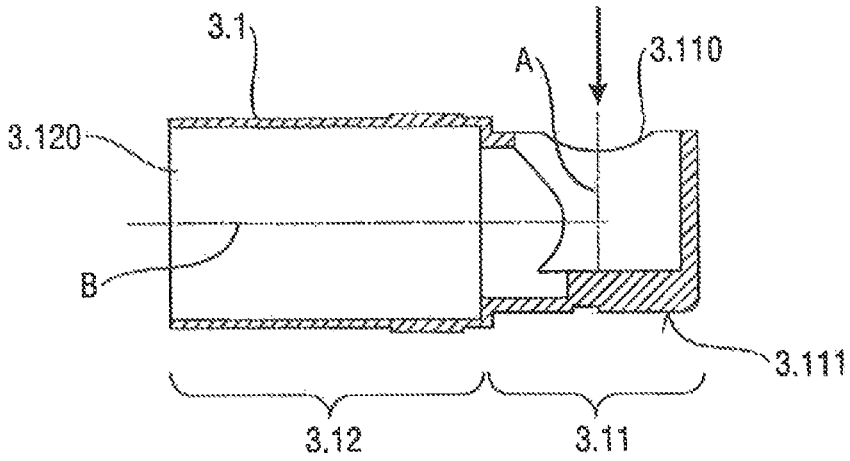
FIG. 4 shows a sectional view of an example first outer conductor part.

FIG. 4 shows a sectional view of a first outer conductor part 3.1 with a connecting area 3.11 to connect to the second outer conductor part 3.2 and a linking area 3.12 to link to a screening braid 6.3 of a cable 6 of a motor vehicle electrical system in accordance with embodiments of this disclosure. The first outer conductor part 3.1 may have a cavity in which additional components can be arranged. The cavity may have two openings 3.110; 3.120 and may be developed such that the additional components. For example, the two parts of an inner conductor 5.1; 5.2, can be arranged at an angle relative to one another through one each opening. In doing so, one of the directions A may correspond to the direction in which a pressing pressure (arrow) may be exerted on the first outer conductor part 3.1 to connect to the second outer conductor part 3.2, and one of the directions B corresponds to the direction that runs parallel to the bearing surface 3.111 arranged in the connecting area 3.11 of the first outer conductor 3.1, which at the same time corresponds to the direction in which the first outer conductor part 3.1 may be slid linearly into the housing 2.

Figure 5:
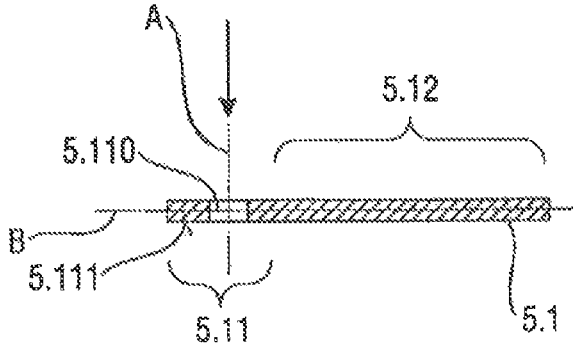
FIG. 5 snows a sectional view of an example first inner conductor part.

FIG. 5 is a schematic diagram of a sectional view of a first inner conductor part 5.1 in accordance with embodiments of this disclosure. The first inner conductor part 5.1 may be developed as a lamellar component with at least two parallel sides and may have a connecting area 5.11 and a linking area 5.12. In the connecting area 5.11, an opening 5.110 may be arranged, which may be penetrated by the second inner conductor part 5.2 for contacting. The axis A of the opening 5.110 may run parallel to the direction (arrow) in which a pressing pressure may be exerted when connecting the first and second inner conductor part 5.1; 5.2. Perpendicular to said axis A may run a bearing surface 5.111 via which a pressing pressure can be discharged to the insulator 4.1 that may surround the first inner conductor part 5.1.

Figure 6A:
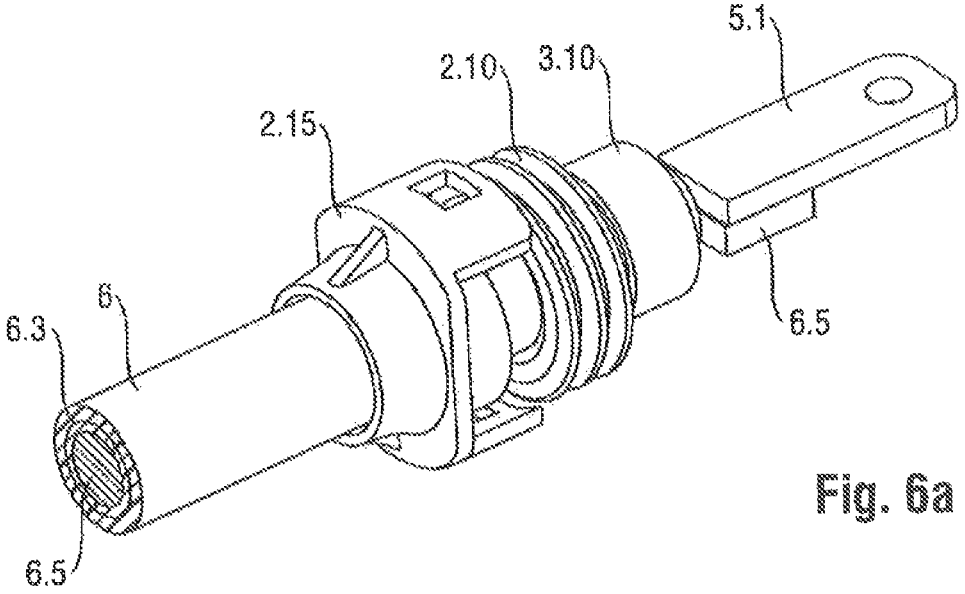
FIG. 6*a-d* shows a schematic diagram of an example assembly in temporal sequence during the production of an angular high-voltage plug according to the invention.
Figure 6B:
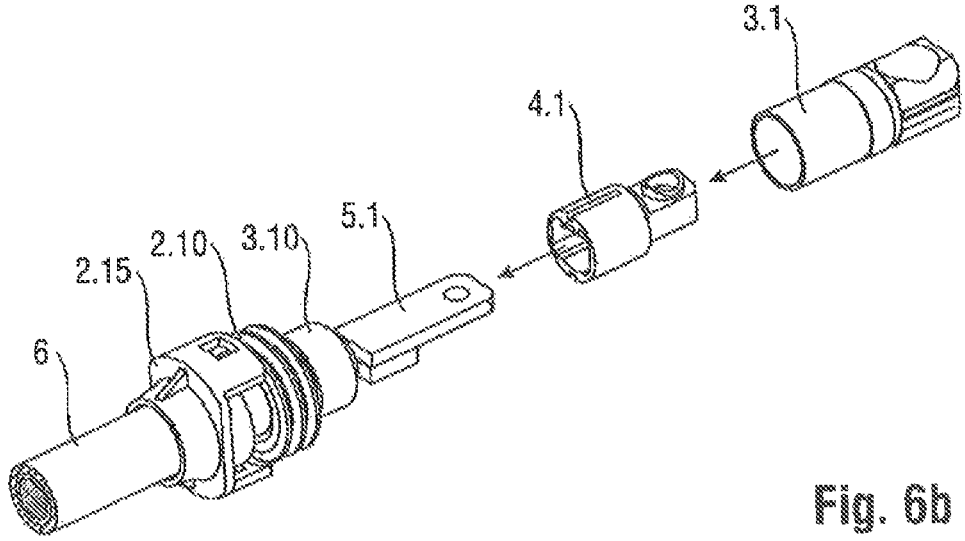

FIGS. **6*a*-6*d* show schematic diagrams of various stages of an assembly diagram in the production of an angular high-voltage plug 1 according to certain embodiments. FIG. 6*a* shows a field-wired cable 6 of a motor vehicle electrical system with a plurality of components of the angular high-voltage plug 1 according to the certain embodiments. The load conductor 6.5 at one end of the cable 6 may be connected to a first inner conductor part 5.1 of an angular high-voltage plug 1 in a welding process. Before connecting the load conductor 6.5 to the first inner conductor part 5.1, a cap 2.15 and a seal 2.10 may be slid over the insulation of cable 6. To affix the screening 6.3 of cable 6, a supporting sleeve 3.10** may be placed on said screening.

Figure 6C:
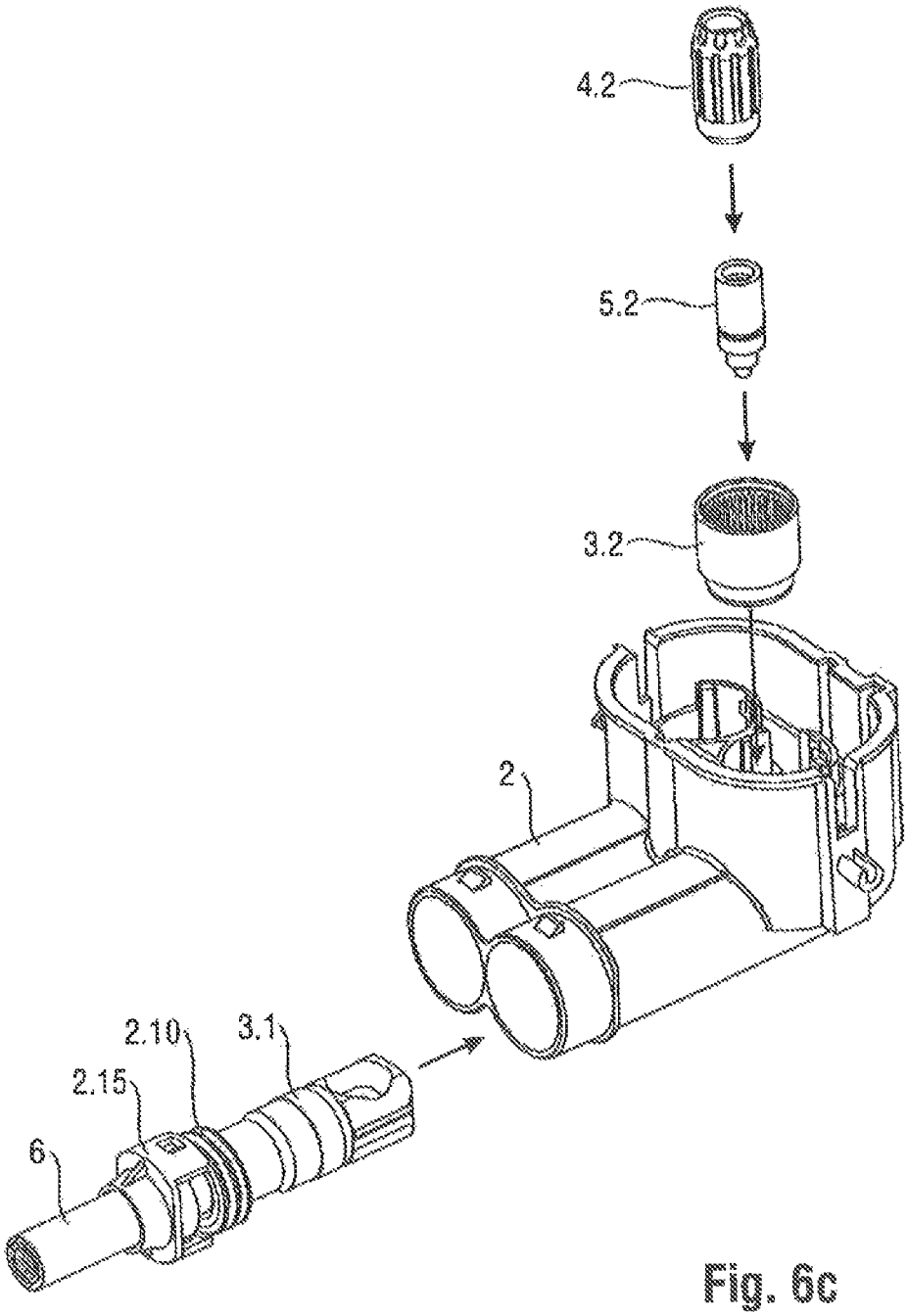
Figure 6D:
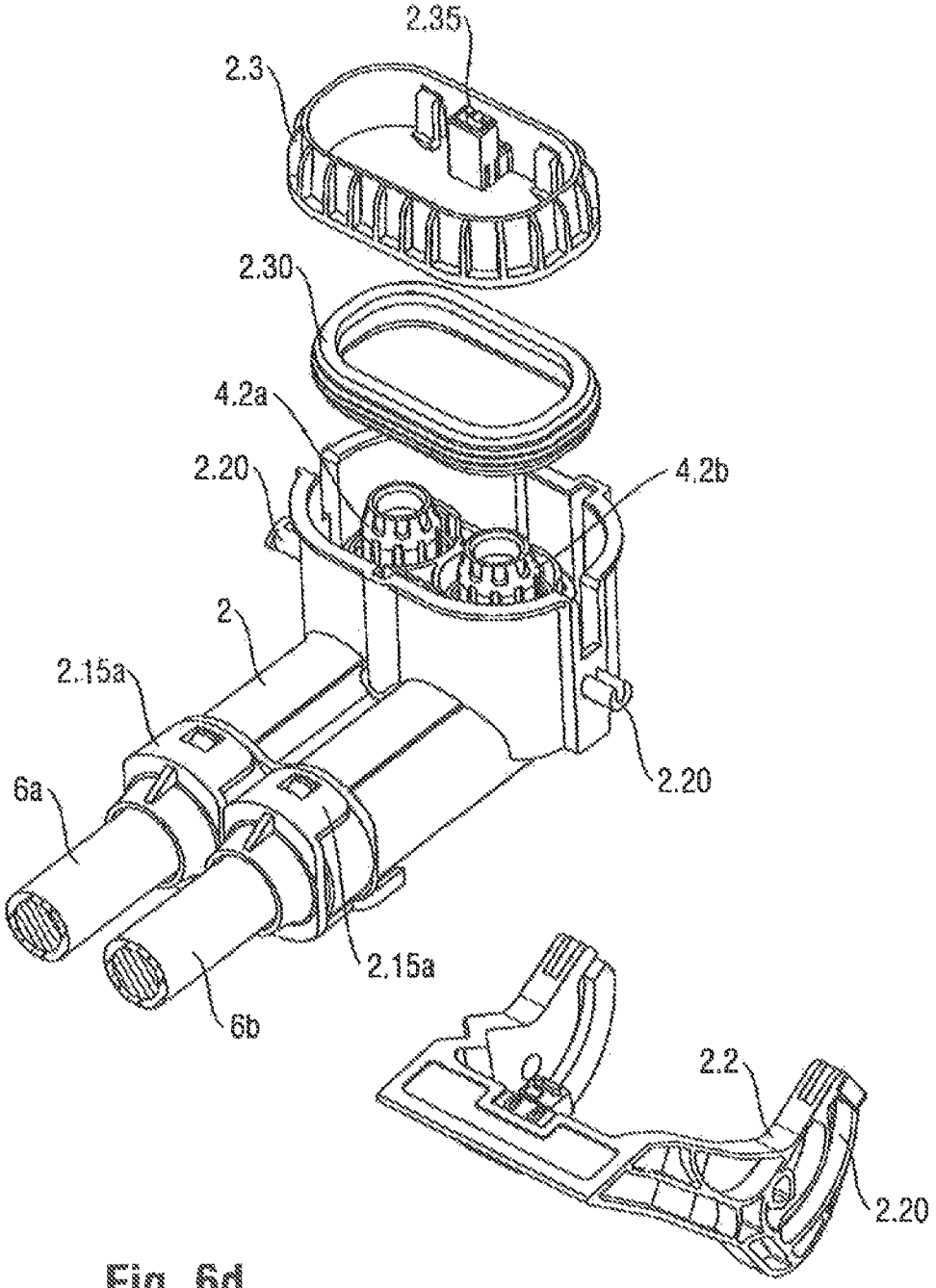

FIG. **6*b* shows a schematic diagram of a next step in accordance with certain embodiments, where an insulator 4.1 and a first outer conductor part 3.1 may be arranged at least about the connecting area 5.11 of the first inner conductor part 5.1. In a next step (not shown), the connecting area 3.11 of the first outer conductor part 3.1 may be connected at least to the supporting sleeve 3.10, such as being crimped. The appropriately created component may be shown in FIG. 6*c*. The cable 6 may be firmly connected to the first outer conductor part 3.1 and the previously mentioned component arranged therein, and the first outer conductor part 3.1 may be slid linearly through a first opening into a cavity of the housing 2, with the contour of the cavity being developed such that the first outer conductor part 3.1 may be arranged in a torsion-resistant fashion in the cavity of the housing 2. The first outer conductor part 3.1 may be affixed in the housing 2 by snapping the cap 2.15 at the housing 2. The lateral opening arranged at the first outer conductor part 3.1 may point into the direction of the second opening of the cavity of the housing 2, through which, in subsequent steps, a second outer conductor part 3.2, a second inner conductor part 5.2 and an insulator cap 4.2** may be arranged in the cavity of the housing.

In a pressing step (not shown) the first and the second outer conductor part 3.1; 3.2 may then be connected by creating an interference fit between the parts. At the same time, the first and the second inner conductor part 5.1; 5.2 may also be interconnected by pressing with the formation of an interference fit. An insulator cap 4.2 may be pressed between the second inner conductor part 5.2 and the second outer conductor part 3.2. The insulator cap may project into the insulator 4.1 such that the parts of the inner conductor 5.1, 5.2 are completely electrically insulated from the parts of the outer conductor 3.1, 3.2. FIG. **6*d* shows a schematic representation of the final assembly steps in accordance with certain embodiments where a circumferential seal 2.30 may be arranged at the plug in the housing 2 at the angular high-voltage plug 1. In an embodiment, said seal may be affixed in the housing 2 with an annular snap element 2.3. The annular snap element 2.3 may have an additional interruption identification 2.35, which may interact with an element arranged in the plug receptacle. In a last assembly step, a clasp 2.2 may be clipped into the housing 2**.

The invention claimed is:

1. An angular high-voltage plug that connects to a cable for use in a high-voltage electrical system of a motor vehicle, comprising:

an electrically-insulating housing having a cable end and a plug end;

an outer conductor disposed in the housing and including:

a first outer conductor part configured to connect the outer conductor to the cable at the cable end, and a second outer conductor part at the plug end, the second outer conductor part including a screen sleeve and an annular recess on an inner circumference of the second outer conductor part, wherein the first outer conductor part is connected to the second outer conductor part through an interference fit, an inner conductor received in the outer conductor and including:

a first inner conductor part at the cable end, which has a connecting area and a linking area; and a second inner conductor part at the plug end, wherein the first inner conductor part and the second inner conductor part are interconnected using an interference fit;

a contact element separated from the second outer conductor part and arranged in the annular recess of the second outer conductor part; and an insulator cap arranged between the second outer conductor part and the second inner conductor part, wherein an inner circumference of the insulator cap at an end portion of the insulator cap is smaller than an outer circumference of the second inner conductor part.

2. The angular high-voltage plug of claim 1, wherein the first outer conductor part is made of copper or a copper alloy.

3. The angular high-voltage plug of claim 2, wherein the first outer conductor part and the first inner conductor part each have an opening, such that the centers of the openings are on a joint axis.

4. The angular high-voltage plug of claim 3, wherein the first outer conductor part and the first inner conductor part each have a respective contact area with respective bearing surfaces in parallel with one another.

5. The angular high-voltage plug of claim 4, wherein the housing has two parallel surfaces that are adjacent to the connecting area of the first outer conductor part and that are arranged parallel to the bearing surface of the first outer conductor part.

6. The angular high-voltage plug of claim 1, wherein the contact element is a lamella-like contact element.

7. A motor vehicle having a high-voltage electrical system, comprising:

an angular high-voltage plug that connects to a cable for use in the high-voltage electrical system, including:

an electrically-insulating housing having a cable end and a plug end;

an outer conductor disposed in the housing and including:

a first outer conductor part configured to connect the outer conductor to the cable at the cable end, and a second outer conductor part at the plug end, the second outer conductor part including a screen sleeve and an annular recess on an inner circumference of the second outer conductor part, wherein the first outer conductor part is connected to the second outer conductor part through an interference fit, an inner conductor received in the outer conductor and including:

a first inner conductor part at the cable end, which has a connecting area and a linking area; and a second inner conductor part at the plug end, wherein the first inner conductor part and the second inner conductor part are interconnected using an interference fit;

a contact element separated from the second outer conductor part and arranged in the annular recess of the second outer conductor part; and an insulator cap arranged between the second outer conductor part and the second inner conductor part, wherein an inner circumference of the insulator cap at an end portion of the insulator cap is smaller than an outer circumference of the second inner conductor part.

8. The motor vehicle of claim 7, wherein the first inner conductor part is welded to a load conductor of a cable of the electrical system.

9. The motor vehicle of claim 8, wherein the first outer conductor part of the angular high-voltage plug is crimped with a screen of a cable of the electrical system via a supporting sleeve surrounding the screen.

* * * * *